US007776803B2

(12) United States Patent
Leeb et al.

(10) Patent No.: US 7,776,803 B2
(45) **Date of Patent: *Aug. 17, 2010**

(54) WORKING MATERIALS WITH SMART CUTTING FLUIDS

(76) Inventors: Steven B Leeb, 7 Prospect St., Belmont, MA (US) 02178; Elmer C Lupton, 3 Tremont St., Charlestown, MA (US) 02129

( * ) Notice: Subject to any disclaimer, the term of this patent is extended or adjusted under 35 U.S.C. 154(b) by 1062 days.

This patent is subject to a terminal disclaimer.

(21) Appl. No.: 11/423,500

(22) Filed: Jun. 12, 2006

(65) Prior Publication Data

US 2006/0234881 A1 Oct. 19, 2006

Related U.S. Application Data

(63) Continuation-in-part of application No. 10/152,868, filed on May 22, 2002, now Pat. No. 7,060,663.

(60) Provisional application No. 60/296,266, filed on Jun. 5, 2001.

(51) Int. Cl.

| | |
|---|---|
| ***C10M 173/02*** | (2006.01) |
| ***B21B 45/02*** | (2006.01) |
| ***B32B 9/04*** | (2006.01) |
| ***C10M 145/34*** | (2006.01) |

(52) U.S. Cl. ..... 508/579; 72/42; 428/411.1

(58) Field of Classification Search ..... 508/579; 72/42; 428/411.1

See application file for complete search history.

(56) References Cited

U.S. PATENT DOCUMENTS

| | | | | |
|---|---|---|---|---|
| 2,825,693 | A * | 3/1958 | Reamer et al. | 508/174 |
| 4,100,271 | A | 7/1978 | Krezanoski | |
| 4,312,768 | A * | 1/1982 | Nassry et al. | 508/250 |
| 4,781,847 | A * | 11/1988 | Weitz | 508/216 |
| 5,259,970 | A * | 11/1993 | Kanamori et al. | 252/73 |
| 5,766,704 | A | 6/1998 | Allen et al. | |
| 5,939,485 | A | 8/1999 | Bromberg et al. | |
| 5,985,383 | A | 11/1999 | Allen et al. | |
| 6,316,011 | B1 | 11/2001 | Ron et al. | |

FOREIGN PATENT DOCUMENTS

WO WO98/29487 7/1998

OTHER PUBLICATIONS

El Baradie, M.A., "Cutting Fluids, Part I—Characterisation", J. Materials Processing Tech, Elsevier Science, NY, NY, 56(1996), 786-797.

(Continued)

*Primary Examiner*—Ellen M McAvoy
*Assistant Examiner*—Vishal Vasisth
(74) *Attorney, Agent, or Firm*—Elmer C. Lupton

(57) ABSTRACT

An process for working a material in which a reverse thermal fluid is used as a cutting fluid and, as a result of heat generated during the working process, the fluid increases in temperature above its transition temperature and viscosifies and thickens. In another embodiment, the invention is an article of manufacture of a material which has been worked to increase its temperature and a reverse thermal fluid in intimate thermal contact with the material above the transition temperature of the reverse thermal fluid.

12 Claims, 6 Drawing Sheets

Viscosity/Temperature Curve for a Reverse Thermal Fluid

OTHER PUBLICATIONS

Performance Chemicals Product Brochure, BASF, Mt. Olive, NJ, Copyright 1997.

Performance Chemicals Pluronic and Tetronic surfactants, BASF, Mt. Olive, NJ, Copyright 1996.

Eckard A., Riff I., and Weaver J., "Formation of Soluble Oils with Synthetic and Petroleum Sulfonates", J. Soc. Tribologists and Lubrication Engineers, STLE, Park Ridge, IL, Jun. 1997 (Presented May 1996).

Bell, D. D., Chou J., Nowag L. and Liang S. Y., "Modeling the Environmental Effect of Cutting Fluid", Tribology Transactions, STLE, Park Ridge, IL, vol. 42 (1999), 1, 168-173, Feb. 1999.

Note: For El Baradie, Performance Chemicals Product Brochure and Performance Chemicals Pluronic and Tetronic surfactants, the year of publication is sufficiently earlier than the effective U.S. filing date so that the particular month of publication is not in issue.

U.S. Appl. No. 11/423,500 relies on U.S. Appl. No. 10/152,868 now US Patent 7060663 for a effective filing date under 35USC120.

U.S. Appl. No. 11/423,500 relies on U.S. Appl. No. 10/152,868 now US Patent 7060663 for a effective date under 35USC120.

* cited by examiner

Figure 1 - Viscosity/Temperature Curve for a Reverse Thermal Fluid

Figure 2 - Worked Drill Bit with Viscosified Reverse Thermal Fluidin Intimate Thermal Contact Figure 3 - Viscosified Reverse Thermal Fluid after Working

WORKING MATERIALS WITH SMART CUTTING FLUIDS

PRIORITY CLAIMED TO PREVIOUS APPLICATION

This application is a continuation in part of application Ser. No. 10/152,868 filed May 22, 2002, now Pat. No. 7,060,663; which claims the benefit of provisional patent application 60/296,266 filed Jun. 5, 2001 "Cutting Fluids", The contents of both of these applications are incorporated in their entirety herein by reference.

FIELD OF THE INVENTION

The present invention relates to the use of the reverse thermal fluids for use as cutting fluids. The present invention further relates to methods for working materials in an improved manner. The present invention further relates to the intermediate articles of manufacture which occur in the use of reverse thermal fluids as cutting fluids.

BACKGROUND OF THE INVENTION

In this patent application, we will use the term "working" a material to mean processes which involve friction in changing the shape of a material such that heat is generated and the temperature of the material is increased, either overall or at the specific place where the working is conducted. Examples of processes which would fall within our meaning of this term, not intending to be limiting, would include drilling, cutting with a saw, machining, lathing and polishing. During the working of a material, heat is generated. This can cause a change in dimensions, softening of working tools and galling and possible binding of tools during working. In order to keep the material and the working tools at a lower temperature and to carry away chips and shards from the working process, a cutting fluid is often used. This is a fluid which is allowed to flow over the surfaces being worked. It can carry away heat, keep the temperature of the working surfaces in controlled range and carry away shards and chips generated in working the material.

A class of fluids exists called reverse thermal fluids. This class of fluids is characterized in that they have a lower viscosity at a lower temperature, then show an increase in viscosity as the temperature is increased. The temperature range over which the viscosity shows this viscosity is called the transition temperature. For some reverse thermal fluids, the degree of viscosity increase can be quite large—over an order of magnitude or more—and the transition temperature range can be narrow—in the range of 5 to 10 degrees C. More information about reverse thermal fluids is given below.

We have invented a process for working materials in which a reverse thermal fluid is used as a cutting fluid. The fluid is initially below its transition temperature and is allowed to flow onto the material being worked. As the fluid comes into intimate thermal contact with the material being worked, the fluid temperature increased above the transition temperature and the fluid viscosifies and remains in contact with the parts being worked. This reduces the volume of cutting fluid being used and so decreases the quantity of fluid which needs to be treated as contaminated waste. It increases the ability of the cutting fluid to control the temperature of the surfaces being worked. If the cutting fluid contains expensive anti-rust additives or other additives, it reduces the quantity of these expensive additives which must be used. During the process of working materials, an article of manufacture is formed in which the surfaces being worked are in intimate contact with the reverse thermal fluid at a temperature above its transition temperature.

This invention is the first to propose the use of a reverse thermal fluid as a cutting fluid. It is the first to propose an article of manufacture in which a surface being worked is in intimate contact with a reverse thermal fluid at a temperature above its transition temperature. It is the first to propose the inclusion of antirust additives or other additives to a reverse thermal fluid to improve its performance as a cutting fluid. Improvements made in the current invention can result in unprecedented performance advantages in working of materials and in the reduction of fluids which must be handled as contaminated waste.

SUMMARY OF THE INVENTION

In one aspect, the invention is a process for working materials in which a reverse thermal fluid is used as a cutting fluid. In another aspect, the invention is an article of manufacture in which a surface being worked is in intimate contact with a reverse thermal fluid at a temperature above its transition temperature. In another aspect, the invention is a reverse thermal fluid including antirust additives or other additives to improve performance as a cutting fluid.

By "material" as the term is used herein, it is meant a solid substance including, but not limited to a metal, a plastic, wood, a ceramic, and glass.

By "working" as the term is used herein, it is meant a process which involve friction in changing the shape of a material such that heat is generated and the temperature of the material is increased, either overall or at the specific place where the working is conducted.

By "reverse thermal fluid" as the term is used herein, it is meant a fluid which shows a substantial reversible increase in viscosity as the temperature of the fluid is increased.

By "transition temperature" is meant the temperature at which the most substantial reversible increase in viscosity of a reverse thermal fluid is noted.

By "transition temperature range" is meant the temperature range over which the substantial reversible increase in viscosity of a reverse thermal fluid is noted.

By "poloxamers" are meant block copolymers of polyoxyethylene and polyoxypropylene.

By "intimate thermal contact" is meant that two materials or a material and a fluid are directly touching so that heat flows from one substance to another.

By "lower viscosity range" is meant the range of viscosity of a reverse thermal fluid which is would be representative of the viscosity below its transition temperature and is relatively non-viscous By "higher viscosity range" is meant the range of viscosity of a reverse thermal fluid which would be representative of the viscosity immediately above its transition temperature and is relatively viscous.

By "materials which produce hazardous fragments" are meant materials which in fragment or powdered form have a toxicity or other hazardous nature greater than would be the case just from the size of the particles. Without intending to be limiting, examples of such materials would be beryllium metal and thallium metal.

By "additional additive" is meant a material which is an antirust ingredient or other ingredient added to the reverse thermal fluid other than the solvent and the polymer which creates the reverse thermal fluid.

By "equipment means to work a material" is meant a type of equipment which can directly effect working of a material.

Equipment means to work a material would include, but not be limited to a drill bit, a saw blade, a machining tool, a lathing blade and a polishing wheel.

In the principle embodiment of the invention, a process for working a material is provided. A reverse thermal fluid is provided as a cutting fluid such that the temperature of the reverse thermal fluid is increased above its transition temperature and its viscosity increases.

BRIEF DESCRIPTION OF THE DRAWINGS

The invention will be understood with reference to the drawings, in which.

DETAILED DESCRIPTION OF THE INVENTION

Figure 1:
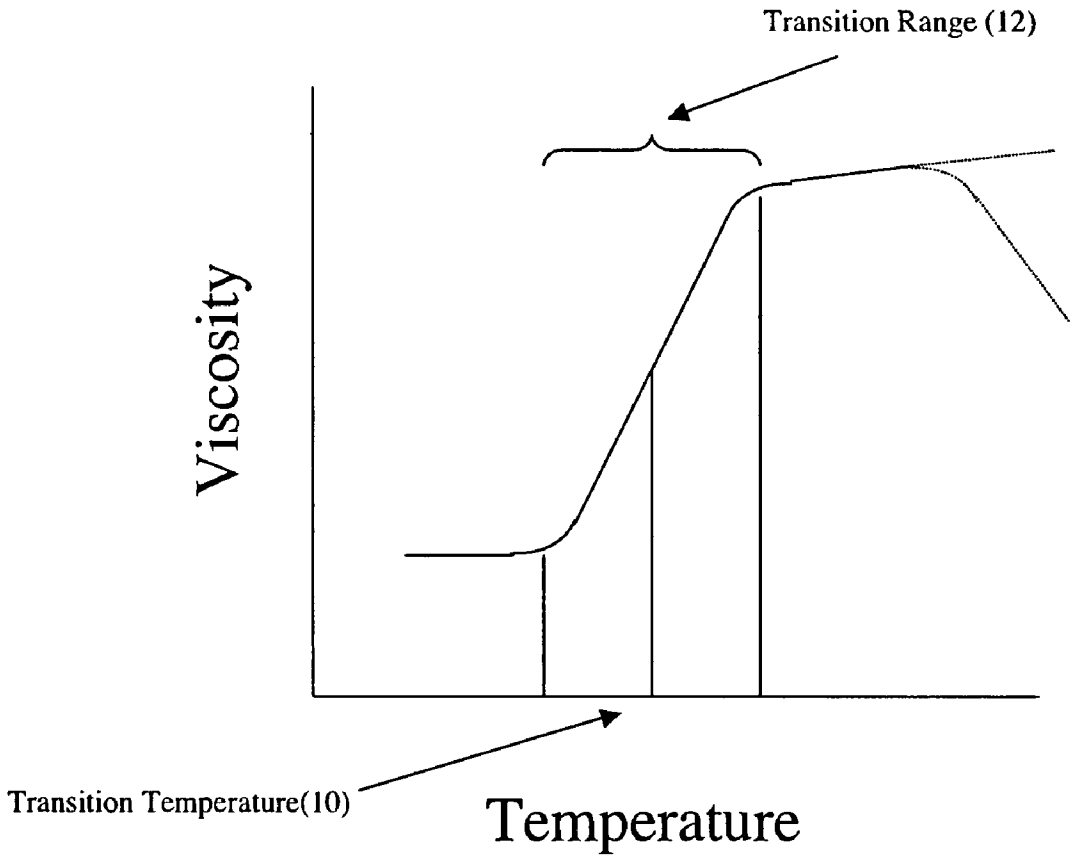
FIG. 1 is generalized viscosity-temperature curve of a reverse thermal fluid.

According to K. H. Moltrech, *Machine Shop Practice,* Vol I, Industrial Press Inc., NY, N.Y. 1981, p 212,213, cutting fluids are employed for four basic purposes:

Cooling the tool or cutting implement

Cooling the work piece

Preventing spot thermal welding

Removing chips.

The present invention involves an improved method for working materials. These materials are ordinarily worked using a process involving friction. Commonly, a cutting fluid is allowed to flow over the surfaces being worked so that some or all of the friction generated heat is transferred into the fluid and is carried away. Because the cutting fluid typically has a very low viscosity (<10 centipoise), any given portion of cutting fluid remains in contact with the surfaces being worked for a very short period of time and large quantities of cutting fluid are needed. Alternately, some working operations require the collection and reuse of cutting fluid with the accompanying complexity and possibility of contamination.

There are a number of processes which exist for working a material. These would include, without intending to be exhaustive, drilling, cutting with a saw, machining, lathing and polishing. Each working process will typically have one or more pieces of equipment means which are used to effect the working. For example, drilling might require a drill bit and a drill or drill press; cutting with a saw might require a circular saw or a band saw and appropriate saw blades; machining and lathing might require a lathe and polishing might require a polishing wheel and abrasives.

Cutting fluids are commonly water based although solvent based cutting fluids are also known. Since the materials being worked can be ferrous metals which are prone to rust or other corrosion, particularly when in contact with water, additional additives like antirust ingredients are sometimes added to cutting fluids. Other additional additives like ingredients with lubricating or other function can also be added to conventional cutting fluids. Without intending to be limiting as to additional additives, a number of these ingredients and additives are described in M. A. El Baradie "Cutting Fluids: Part I. Characterisation", J. of Materials Processing Technology 56 (1996) 786-797 which is incorporated herein in its entirety by reference.

Most fluids show a decrease in viscosity as their temperature increases. Typically, this viscosity decrease with temperature is rather gradual. However, there are a few reverse thermal fluids which show, in certain portions of the temperature range and at certain concentrations, an increase in viscosity as the temperature increases, and for some materials, this increase can be quite dramatic—an order of magnitude or more—or becoming in some cases, a gel. One such type of fluid is the aqueous solution of polyoxyethylene/polyoxypropylene/polyoxyethylene copolymers (generically called poloxamers; trademarked Pluronic) in water. The reverse thermal fluid behavior of these solutions is known in the prior art as in Allen, U.S. Pat. No. 5,985,383 which is incorporated herein in its entirety by reference; Allen, U.S. Pat. No. 5,766,704 which is incorporated herein in its entirety by reference; Krezanoski, U.S. Pat. No. 4,100,271 which is incorporated herein in its entirety by reference; BASF Performance Chemicals Product Brochure, copyright 1997 which is incorporated herein in its entirety by reference; and BASF Performance Chemicals PLURONIC and TETRONIC surfactants, copyright 1996 which is incorporated in its entirety herein by reference.

Figure 5:
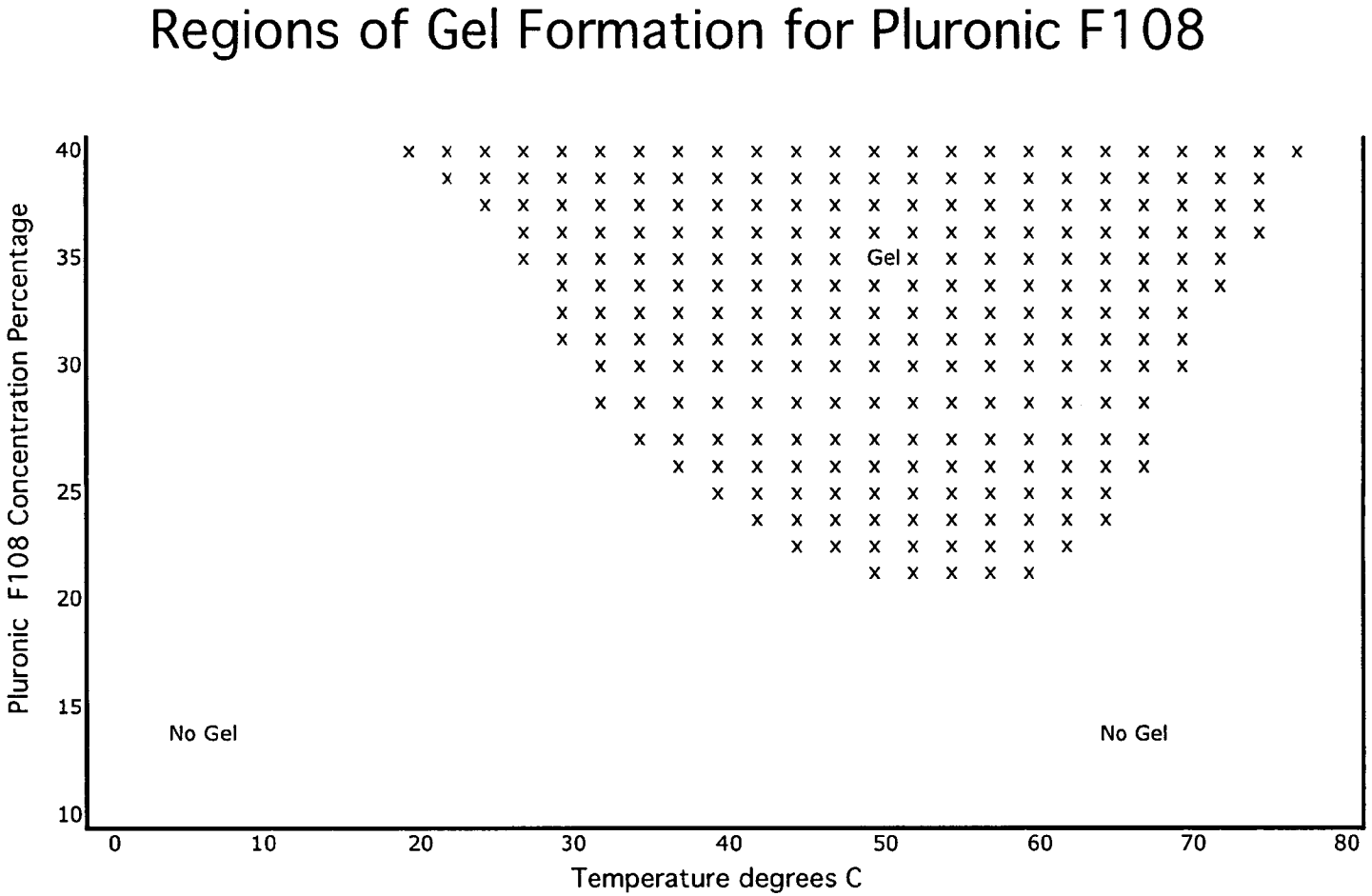
FIG. 5 is "Regions of Gel Formation for Pluronic F108."

There are some poloxamer block copolymers which gel at higher temperature although they are fluid and liquid at lower temperatures. If properly selected, these block copolymers can also function as surfactants. Choice of appropriate copolymer(s) can also enable new formulations to be created for designed availability. FIG. 5 suggests that a 30% concentration of PLURONIC® F108 will function as a gel providing pharmaceutical active components at 37 degrees C. but will be a liquid at 20-25 degrees C.

Hydrogen bonding in water solutions of poloxamer block copolymers, in which the protons on water bond with the oxygen atoms from the ether linkage of the block copolymers, is considered to be the reason for gel formation by these materials. PLURONIC F127®, because of its large molecular weight and degree of incorporation of (—$CH_2$—$CH_2$—O—) groups, should be a primary choice in selection of potential components.

Figure 4:
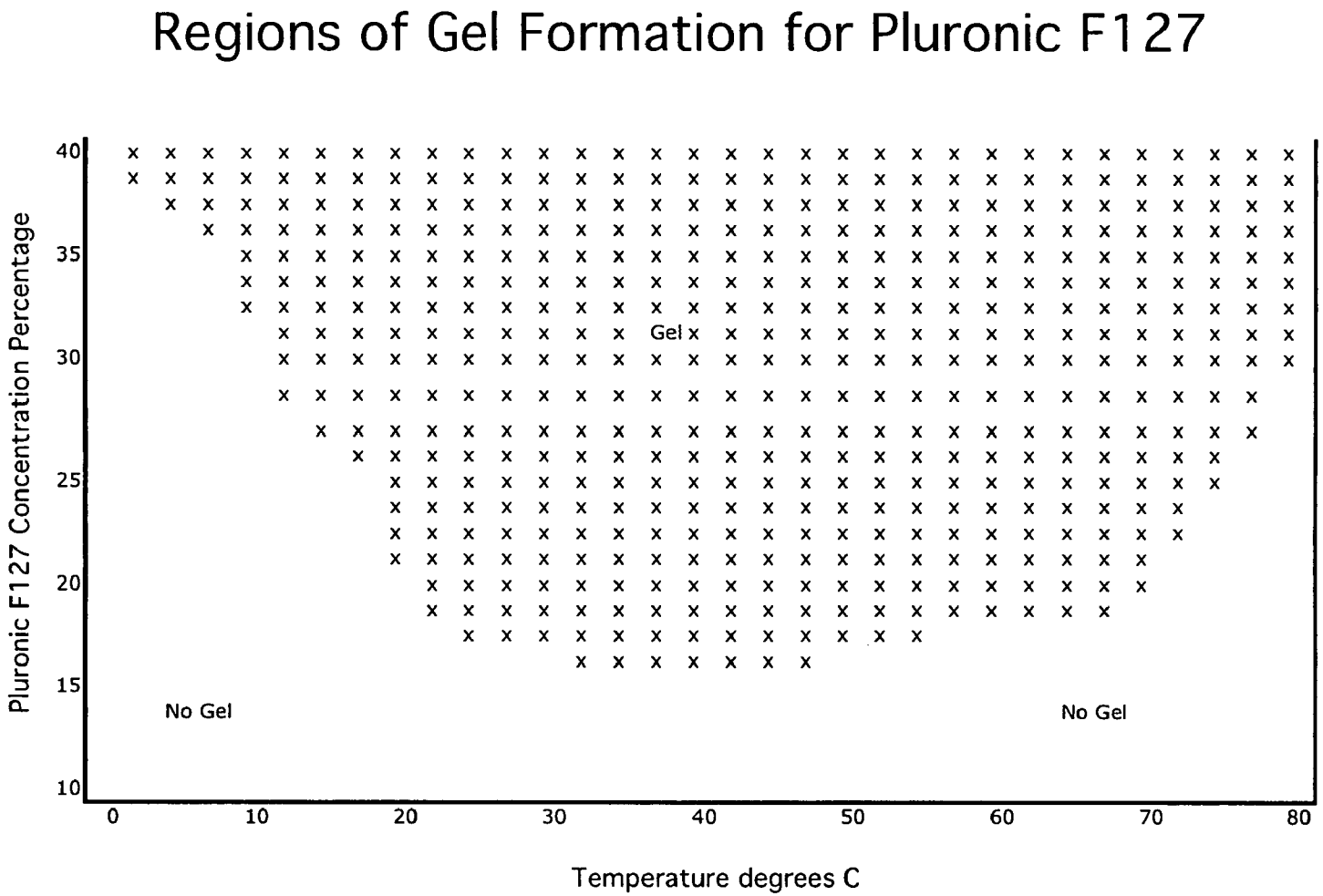
FIG. 4 is "Regions of Gel formation for Pluronic F127."
Figure 6:
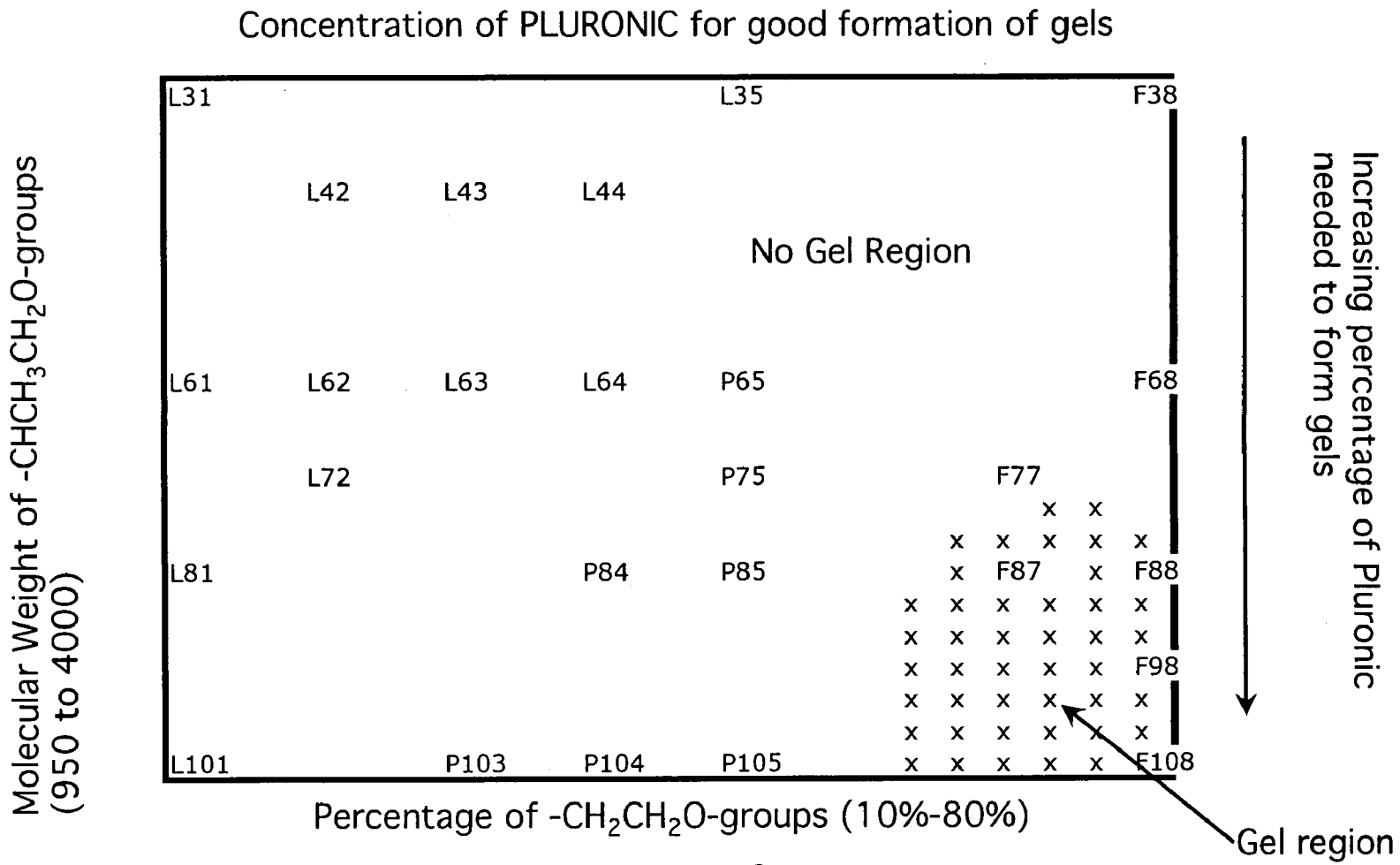
FIG. 6 is "Concentration of PLURONIC for good formation of gels"

As the chain length of the polymer and the percentage of (—$CH_2$—$CH_2$—O—) groups go up, poloxamer block copolymers become more likely to form gels. See FIGS. 4 and 6 to determine compositions to evaluate in preparing a gel. Some TETRONIC® polymeric materials will also form gels.

There are additional components which can be added to a gel which affect the strength of the gel. Some of these components can make the gel less strong while others can make the gel stronger. If components of this type are part of the gel formulation, they may have impact on the strength of the gel and it may be necessary to prepare a different formulation to meet the performance properties which are preferred for the application. Some factors which can have an effect on gel strength are: 1) Surfactant molecules may make the gel less strong as they influence the structure of the hydrogen bonding 2) Ionic materials like strong electrolytes or salts of inorganic ions can make gels less strong 3) Gels can be made less strong by some small soluble organic molecules which can serve as solvents 4) Gels can be made stronger and more stiff by the addition in low concentration of organic molecules which are not water soluble 5) Increasing the pH of a solution can allow equivalent strength of the gel to be maintained while using less block copolymer 6) Increasing or decreasing the concentration of block copolymer.

Some properties of poloxamer block copolymers are:

PLURONIC F127
Average Molecular Weight—12,600
HLB Value at 25 degrees C.—22
mm foam height (50 degrees C., 0.1%, Ross Mills)—40
Surface Tension (dynes/cm, 25 degrees C., 0.1%)—40.6
Cloud Point (Degrees C., 1% aqueous solution)—>100
Form of concentrated material—Solid PLURONIC F108
Average Molecular Weight—14,600
HLB Value at 25 degrees C.—27
mm foam height (50 degrees C., 0.1%, Ross Mills)—40
Surface Tension (dynes/cm, 25 degrees C., 0.1%)—41.2
Cloud Point (Degrees C., 1% aqueous solution)—>100
Form of concentrated material—Solid Another type is the responsive polymer network, comprising a responsive component capable of aggregation in response to a change in an environmental stimulus; a structural component which supports and interacts with the responsive component; and an aqueous-based solvent wherein said responsive polymer network comprises less than about 4 weight percent of total polymer solids and further wherein the viscosity of the responsive polymer network increases by at least about 30 times or more upon exposure to the environmental stimulus and still further wherein the responsive and structural components interact with one another as in Bromberg et. al. U.S. Pat. No. 5,939,485 which is incorporated herein in its entirety by reference and Bromberg et. al. PCT Application WO98/29487 which is incorporated herein in its entirety by reference. Another type is the aqueous solution of a linear block copolymer comprising: at least a first polyoxyalkylene block having a hydrophobic region and a hydrophilic region effective to form micelles in solution in response to a change in temperature, and at least a second block comprising a bioadhesive polymer or oligomer, wherein the linear block copolymer is dispersed in an aqueous medium and the composition reversibly viscosifiers at a temperature in the range of 22 to 40.degree. C. as in Ron, et. al. U.S. Pat. No. 6,316,011 which is incorporated herein in its entirety by reference.

A representation of the viscosity/temperature curve for a reverse thermal fluid is shown in FIG. I. Below the transition temperature, the fluid is low in viscosity and flows readily. As the temperature enters the transition range (12) and approaches the transition temperature (10), the fluid shows a substantial increase in viscosity. As the fluid's temperature reaches the upper end of the transition temperature range, the rate of increase of viscosity diminishes greatly or, in some cases, the viscosity becomes approximately constant. In some cases, the viscosity will begin to decrease as the temperature is further increased while in others, the viscosity appears to remain constant or to increase slightly. These two alternatives are shown with dotted lines on FIG. I.

Figure 2:
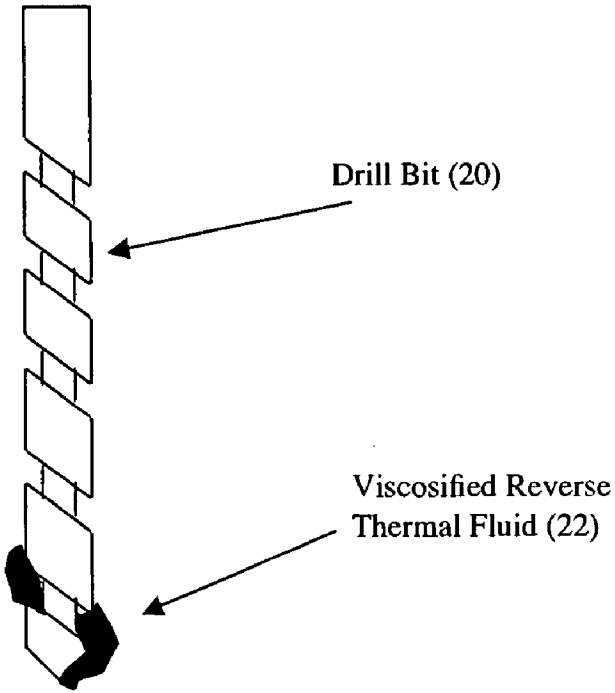
FIG. 2 is a drawing of an embodiment of a material (a drill bit) in intimate contact with a viscosified reverse thermal fluid.

For some of the reverse thermal fluids, the range of concentrations over which reverse thermal viscosification occurs is limited and outside of that range or those ranges, the phenomenon does not occur and the fluid would not be considered a reverse thermal fluid. For example, the material of Bromberg does not function as a reverse thermal fluid below about pH 5 (see Bromberg 485 FIG. 2). In addition, some of the additives mentioned above can change the reverse thermal viscosification range of the fluid mixture requiring adjustment of concentrations to continue to perform as a reverse thermal fluid. See, for example, Bromberg 485 Example 8 and FIG. 12 which describe the effect of the addition of salt to the viscosity, transition temperature and transition temperature range of his material. The process of adjustment of gel strength is described in BASF Performance Chemicals PLURONIC AND TETRONIC Surfactants, Copyright 1996, page 19. We have found that these same factors can influence the transition temperature and transition range of reverse thermal fluids and it may be necessary to determine empirically the best concentrations for the application. As will be readily understood and could be carried out by one skilled in the art, one experimental strategy could be to hold the concentration of additive constant while varying the concentrations of solvent and copolymer. Other such experimental strategies can be designed and carried out by one skilled in the art.

Our invention uses this temperature/viscosity behavior to create a unique cutting fluid. This fluid has a low viscosity and is very fluid at ambient temperature so that it can easily be handled by normal fluid handling methods. However, when the fluid of our invention comes into contact with a surface being worked, the fluid absorbs some heat and the viscosity of the cutting fluid increases dramatically so that it does not flow but continues to absorb heat and control the temperature of the surfaces being worked. If the material then shows a decrease in viscosity as the temperature increases still further, it may then flow away from the surface carrying away substantial heat.

EXAMPLE I

Into a glass container were placed 180 g of Pluronic F127 (BASF) and 820 g of deionized water at 5-10 degrees C. Pluronic F127 is an ethylene oxide/propyleleneoxide/ethylene oxide block copolymer where the propylene oxide block is about 63 repeat units and each ethylene block is about 96 repeat units The mixture was stirred thoroughly and placed into a refrigerator at 5-10 degrees C. The mixture was stirred twice daily during weekdays and returned to the refrigerator. After 7 days, the reverse thermal fluid is prepared and ready to use.

EXAMPLE II

Into a glass container were placed 200 g of Pluronic F127 (BASF), 50 g of Pluronic F68 (BASF) and 750 g of deionized water at 5-10 degrees C. Pluronic F68 is an ethylene oxide/propylelen oxide/ethylene oxide block copolymer where the propylene oxide block is about 27 repeat units and each ethylene block is about 71 repeat units. The mixture was stirred thoroughly and placed into a refrigerator at 5-10 degrees C. The mixture was stirred twice daily during weekdays and returned to the refrigerator. After 7 days, the reverse thermal fluid is prepared and ready to use.

EXAMPLE III

Into a glass container were placed 18 ml of the fluid from Example I and, as an additional additive, 2 ml of "Bedway Oil" (Lubriplate #3, L-211-0, Fiske Bros., Newark N.J.) which is a fluid used to inhibit rust. The mixture was shaken to achieve mixing.

EXAMPLE IV

Into a glass container were placed 12 ml of the fluid from Example 1 and, as an additional additive, 10 ml of Spindle Oil (Mobil). The mixture was shaken to achieve mixing.

EXAMPLE V

Into a glass container were placed 20 ml of the fluid from Example 1 and, as an additional additive, 2 ml of Mineral Oil (Goodsense, CVS). The mixture was shaken to achieve mixing.

EXAMPLE VI

Into a glass container were placed 20 ml of the fluid from Example 1 and, as an additional additive, 2 ml of "Rustlick" inhibitor. (Rustlick/Accu-Lube/Safetap)

EXAMPLE VII

A metallic drill bit in a drill press was used to drill a piece of aluminum. The drill press operated at approximately 15,000 rpm. The drill bit was allowed to drill into the aluminum for approximately 30 seconds and removed from the aluminum. A thermocouple was quickly placed on the drill bit and the temperature was measured as 41.9 Degrees C. The room temperature and the temperature of the aluminum block were measured as 25 degrees C. A very sizeable quantity of aluminum shavings were observed to be generated and to remain on the block.

EXAMPLE VIII

A few drops of the fluid of example I was placed on the drill bit of Example VII. The drill bit was at room temperature. The drill press was operated for about 3 seconds. All of the fluid was expelled from the bit.

EXAMPLE IX

Figure 3:
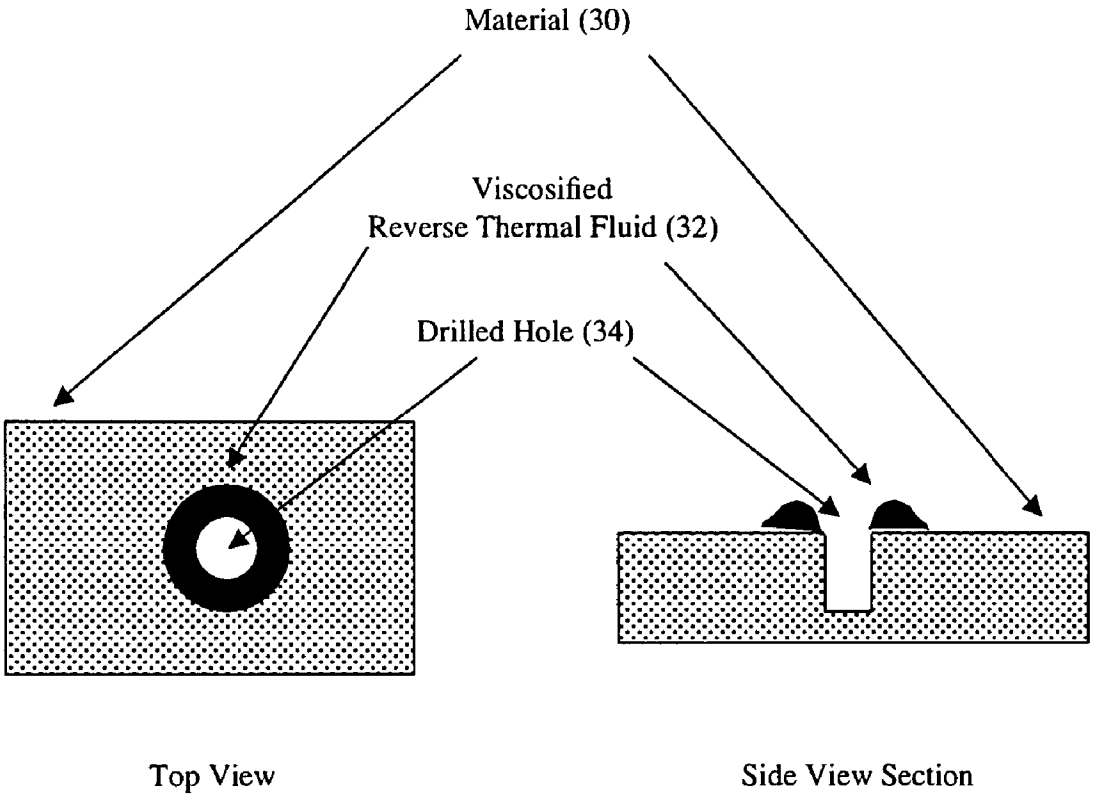
FIG. 3 is a drawing of the torus of viscosified reverse thermal fluid formed on a material after drilling.

The metallic drill bit of Example VII was used to drill into the aluminum block for about 10 seconds. The bit was raised from the block and several drops of the fluid of Example I allowed to run down the drill bit. The fluid thickened, viscosified and stopped running. The drill bit was then used again to drill further into the aluminum block. The fluid viscosified in the hole and on the surface of the block. The viscosified fluid was seen to form a torus approximately 1 cm in diameter centered around the hole. The viscosified fluid contained a substantial visible quantity of metal shavings. The drill bit was removed from the block and the power turned off after about 1-2 seconds. A layer of fluid clearly was observed on the bit. See FIG. 3 showing the metallic drill bit (20) and the viscosified reverse thermal fluid (22).

EXAMPLE X

A few drops of the fluid of example II was placed on the drill bit of Example VII. The drill bit was at room temperature. The drill press was operated for about 3 seconds. All of the fluid was expelled from the bit.

EXAMPLE XI

The metallic drill bit of Example VII was used to drill into the aluminum block for about 10 seconds. The bit was raised from the block and several drops of the fluid of Example II allowed to run down the drill bit. The fluid thickened, viscosified and stopped running. The drill bit was then used again to drill further into the aluminum block. The fluid viscosified in the hole and on the surface of the block. The viscosified fluid was seen to form a torus approximately 1 cm in diameter centered around the hole. The viscosified fluid contained a substantial visible quantity of metal shavings. The drill bit was removed from the block and the power turned off after about 1-2 seconds. A layer of fluid clearly was observed on the bit. See figure III showing the aluminum block (material 30), torus of viscosified reverse thermal fluid (32) and drilled hole (34).

EXAMPLE XII

A few drops of the fluid of example III was placed on the drill bit of Example VII. The drill bit was at room temperature. The drill press was operated for about 3 seconds. All of the fluid was expelled from the bit.

EXAMPLE XIII

A droplet of about 1 ml of the fluid of Example III was placed on the aluminum block. The drill press of Example VII was started and drilled through the droplet into the aluminum block. A torus of viscosified fluid was observed to form on the block about 1 cm in diameter centered on the drilled hole containing a large quantity of aluminum shavings. No shavings were observed to be thrown out of the hole free of the fluid. The drill bit was raised and allowed to run for 1-2 seconds and stopped. A layer of fluid clearly was visible on the drill bit.

EXAMPLE XIV

A droplet of about 1 ml of the fluid of Example IV was placed on the aluminum block. The drill press of Example VII was started and drilled through the droplet into the aluminum block. A torus of viscosified fluid was observed to form on the block about 1 cm in diameter centered on the drilled hole containing a large quantity of aluminum shavings. No shavings were observed to be thrown out of the hole free of the fluid. The drill bit was raised and allowed to run for 1-2 seconds and stopped. A layer of fluid clearly was visible on the drill bit.

EXAMPLE XV

A droplet of about 1 ml of the fluid of Example V was placed on the aluminum block. The drill press of Example VII was started and drilled through the droplet into the aluminum block. A torus of viscosified fluid was observed to form on the block about 1 cm in diameter centered on the drilled hole containing a large quantity of aluminum shavings. No shavings were observed to be thrown out of the hole free of the fluid. The drill bit was raised and allowed to run for 1-2 seconds and stopped. A layer of fluid clearly was visible on the drill bit.

EXAMPLE XVI

A droplet of about 1 ml of the fluid of Example VI was placed on the aluminum block. The drill press of Example VII was started and drilled through the droplet into the aluminum block. A torus of viscosified fluid was observed to form on the block about 1 cm in diameter centered on the drilled hole containing a large quantity of aluminum shavings. No shavings were observed to be thrown out of the hole free of the fluid. The drill bit was raised and allowed to run for 1-2 seconds and stopped. A layer of fluid clearly was visible on the drill bit.

EXAMPLE XVII

A droplet of about 1 ml of Bedway Oil was placed on the aluminum block. The drill press of Example VII was started and drilled through the droplet into the aluminum block. A number of shavings were generated and thrown around the block. No visible torus of fluid was observed. The drill bit was raised and allowed to run for 1-2 seconds and stopped. No layer of fluid was visible on the drill bit.

EXAMPLE XVIII

A sample of the fluid of Example 1 is treated with hydrochloric acid to about pH 2. The metallic drill bit of Example VII is allowed to drill into a piece of stainless steel according to the method of Example IX. The fluid viscosifies in the hole and on the surface of the block. The viscosified fluid is seen to form a torus approximately 1 cm in diameter centered around the hole. The viscosified fluid contains a substantial visible quantity of metal shavings. The drill bit is removed from the block and the power turned off after about 1-2 seconds. A layer of fluid clearly is observed on the bit.

EXAMPLE XIX

A sample of reverse thermal fluid is manufactured according to the method of Bromberg. The concentration of polymer network is about 2% by weight. The pH is about 7.0. The metallic drill bit of Example VII is allowed to drill into a piece of stainless steel according to the method of Example IX. The fluid viscosifies in the hole and on the surface of the block. The viscosified fluid is seen to form a torus approximately 1 cm in diameter centered around the hole.

The viscosified fluid contains a substantial visible quantity of metal shavings. The drill bit is removed from the block and the power turned off after about 1-2 seconds. A layer of fluid clearly is observed on the bit.

EXAMPLE XX

A portion of the reverse thermal fluid of Example XIX is treated with hydrochloric acid to reduce the pH to about 2.0. The metallic drill bit of Example VII is allowed to drill into a piece of stainless steel according to the method of Example IX. No fluid viscosifies in the hole and on the surface of the block. The drill bit is removed from the block and the power turned off after about 1-2 seconds. No layer of viscosified fluid is clearly is observed on the bit.

It should be realized by those skilled in the art that other, equivalent constructions to implement a method of working materials using a reverse thermal fluid and other equivalent articles of manufacture comprising a material and a reverse thermal fluid above its transition temperature do not depart from the spirit and scope of the invention as set forth in the appended claims.

What is claimed is:

1. A process for working a material comprising:

a) Providing the material b) Providing equipment means to work the material c) Providing a reverse thermal fluid at a temperature below its transition temperature d) Using the equipment means to work the material so that friction is created, heat is generated and the temperature of the material is increased e) Applying the reverse thermal fluid to the material or to the equipment means to work the material, or to both the material and to the equipment means to work the material before or during the process of working so that the temperature of the reverse thermal fluid increases above its transition temperature and its viscosity increases In which said reverse thermal fluid comprises an aqueous solution of a poloxamer or mixture of poloxamers in which the concentration of poloxamer or mixture of poloxamers is greater than about 18% by weight in which said poloxamer or mixture of poloxamers consists of polyoxyethylene units and polyoxypropylene units in which a visible layer of the reverse thermal fluid with temperature above its transition temperature and with increased viscosity adheres to the material.

2. The process of claim 1 in which the material comprises a material which produces hazardous fragments.

3. The process of claim 1 in which the reverse thermal fluid further comprises one or more additional additives.

4. The process of claim 2 in which the additional additive further comprises an antirust additive.

5. An article of manufacture comprising:

a) A material which is being worked or which has recently been worked so that heat has been generated and b) A reverse thermal fluid in intimate thermal contact with the material where the temperature of the reverse thermal fluid is above its transition temperature and is in its higher viscosity range in which said reverse thermal fluid comprises an aqueous solution of a poloxamer or mixture of poloxamers in which the concentration of poloxamer or mixture of poloxamers is greater than about 18% by weight in which said poloxamer or mixture of poloxamers consists of polyoxyethylene units and polyoxypropylene units in which a visible layer of the reverse thermal fluid with temperature above its transition temperature and with increased viscosity adheres to the material.

6. The article of manufacture of claim 5 in which the material comprises a material which produces hazardous fragments.

7. The article of manufacture of claim 5 in which the reverse thermal fluid further comprises one or more additional additives.

8. The article of manufacture of claim 6 in which the additional additive further comprises an antirust additive.

9. An article of manufacture comprising:

a) An equipment means which is working a material or has recently worked a material so that heat is generated and b) A reverses thermal fluid in intimate thermal contact with the material where the temperature of the reverse thermal fluid is above its transition temperature and is in its higher viscosity range in which said reverse thermal fluid comprises an aqueous solution of a poloxamer or mixture of poloxamers in which the concentration of poloxamer or mixture of poloxamers is greater than about 18% by weight and in which said poloxamer or mixture of poloxamers consists of polyoxyethylene units and polyoxypropylene units in which a visible layer of the reverse thermal fluid with temperature above its transition temperature and with increased viscosity adheres to the material.

10. The article of manufacture of claim 9 in which the reverse thermal fluid further comprises one or more additional additives.

11. The article of manufacture of claim 9 in which the material further comprises a material which produces hazardous fragments.

12. The article of manufacture of claim 10 in which the reverse thermal fluid further comprises an antirust additive.

* * * * *